US006336299B1

(12) United States Patent
Wixom

(10) Patent No.: US 6,336,299 B1
(45) Date of Patent: Jan. 8, 2002

(54) FOOD STORAGE BUILDING FLOOR AND METHOD OF CONSTRUCTING THE SAME

(76) Inventor: Steven D. Wixom, 1725 Riverton Rd., Blackfoot, ID (US) 83221

( * ) Notice: Subject to any disclaimer, the term of this patent is extended or adjusted under 35 U.S.C. 154(b) by 0 days.

(21) Appl. No.: 09/643,107

(22) Filed: Aug. 21, 2000

(51) Int. Cl.[7] ..... E04B 1/70

(52) U.S. Cl. ..... 52/302.1; 52/302.2; 52/220.4; 52/262; 52/506.04; 454/173; 454/179; 454/183; 454/180; 454/181; 454/175; 454/174; 99/473; 99/474; 99/475; 99/476; 34/210; 34/211; 34/235

(58) Field of Search ..... 52/302.1, 302.2, 52/220.4, 262, 506.04; 454/173–175, 179–181, 183; 99/473–476; 34/210, 211, 235

(56) References Cited

U.S. PATENT DOCUMENTS

| | | | |
|---|---|---|---|
| 4,466,450 | A | 8/1984 | Huszczo |
| 4,580,487 | A | 4/1986 | Soshowski |
| 5,353,564 | A | 10/1994 | Hansen |
| 5,713,172 | A | 2/1998 | Tegland |
| 5,789,007 | A | 8/1998 | Bianco |

*Primary Examiner*—Beth A. Stephan
*Assistant Examiner*—Dennis L. Dorsey
(74) *Attorney, Agent, or Firm*—Liebler, Ivey & Connor; Floyd E. Ivey

(57) ABSTRACT

A storage floor air vent may comprise at least two vent walls positioned in substantially parallel relation to thereby define a channel; a plurality of angular baffle members, each angular baffle member composed of two segments forming an apex therebetween; the plurality of angular baffle members positioned in between the at least two vent walls in a linear arrangement, with each apex facing upward proximal the top end of each of the at least two vent walls, and each angular baffle member is positioned a distance apart from the adjacent angular baffle member to thereby define an orifice between the segment ends of adjacent angular baffle members. The invention further includes a building floor which may comprise a lower floor; a plurality of pony walls positioned atop the lower floor in substantially parallel relation; an upper floor positioned atop the plurality of pony walls to thereby define an air duct in between adjacent pony walls and the lower and upper floors, the upper floor comprising at least one storage floor air vent positioned atop the plurality of pony walls in a substantially orthogonal relation to the plurality of pony walls with each vent wall bottom end proximal the air duct in between adjacent pony walls. The invention further discloses a method of constructing the building floor.

14 Claims, 5 Drawing Sheets

FOOD STORAGE BUILDING FLOOR AND METHOD OF CONSTRUCTING THE SAME

FIELD OF THE INVENTION

The present invention relates generally to vents and particularly to a food storage building floor and a method of constructing the same.

BACKGROUND OF THE INVENTION

Certain fresh fruits and vegetables may be stored in bulk in buildings with controlled atmospheres including circulation of the air for the purpose of retaining produce freshness or decreasing the time within which produce spoilage might occur. In a typical food storage building, air is circulated through a large plenum and into air ducts located below the building floor. The air ducts may be formed by pony walls juxtaposed the plenum that also support the floor. The air then travels through vents located within the floor and circulates through the stored fruits or vegetables.

There are a number of building floor systems that have been used. However none of them accomplish the result as contemplated by the present invention. Typically, the floors include thousands of individual vents positioned within the concrete. These floors may require a large amount of money and labor to construct and the concrete surrounding the vents must be done in a single pour. Adverse weather conditions may hinder this construction. They may also be susceptible to damage from equipment or vehicles on the floor. For example, some storage building floors utilizes wooden slots that are placed over concrete slabs. The typical commodity storage facility floor will have thousands of such air vents. The wood slots create an uneven floor surface making it difficult to load and unload bulk produce and to clean the storage building.

U.S. Pat. No. 5,713,172 to Tegland discloses a storage floor air vent and method of use that includes placing the vents, that are each plugged with a block out, in holes in metal sheets, pouring concrete over the entire floor area including the vents, and finally breaking through and removing the concrete surface above each storage floor air vent and the block out thereby permitting passage of air through the storage floor air vent. The patent referred to herein are provided herewith in an Information Disclosure Statement in accordance with 37 CFR 1.97.

SUMMARY OF THE INVENTION

The present invention discloses a storage floor air vent which may comprise at least two vent walls positioned in substantially parallel relation to thereby define a channel having a width in between said at least two vent walls, each of said at least two vent walls having a top end, a bottom end, a first side end, and a second side end; a plurality of angular baffle members, each angular baffle member composed of two segments forming an apex therebetween, each segment having an end; said plurality of angular baffle members may be positioned in between said at least two vent walls in a linear arrangement, with each apex facing upward proximal the top end of each of said at least two vent walls, and each angular baffle member is positioned a distance apart from the adjacent angular baffle member to thereby define an orifice between the segment ends of adjacent angular baffle members.

The orifice may be of various sizes depending upon the storage contents and ventilation requirements.

The storage floor air vent may further comprise a flange extending outwardly and approximately normal from the bottom end of each of said at least two vent walls.

The storage floor air vent may further comprise at least one cap having a width approximately equal to the channel width; said at least one cap is positioned atop at least two of said apexes. The at least one cap may be of various shapes, sizes or configurations. The cap prevents any concrete or other material from entering the vent while a floor is being poured.

The invention further discloses a building floor which may comprise a lower floor; a plurality of pony walls positioned atop the lower floor in substantially parallel relation; an upper floor positioned atop the plurality of pony walls to thereby define an air duct in between adjacent pony walls and said lower and upper floors, said upper floor comprising at least one storage floor air vent positioned atop the plurality of pony walls in a substantially orthogonal relation to said plurality of pony walls with each vent wall bottom end proximal the air duct in between adjacent pony walls. Additional embodiments may include other air duct configurations including, but not limited to, conduit or pipes that transmit air.

The building floor may further comprise at least one plenum juxtaposed said air duct in between adjacent pony walls.

The invention further discloses a method of constructing a building floor comprising the steps of: placing at least one storage floor air vent in a substantially orthogonal position across a plurality of pony walls in substantially parallel relation to each other, said at least one storage floor air vent having at least one cap covering the top end of the at least one storage floor air vent; placing at least one support sheet across said pony walls and next to said at least one storage floor air vent and atop each flange; covering the floor area, encompassing the at least one support sheet, with a concrete slab sufficiently to permit concrete finishing; and removing the at least one cap. Said at least one support sheet is preferably composed of galvanized metal but may be composed of other materials including, but not limited to, plastics or other rigid materials. Each vent apex is preferably positioned a distance below the top of the upper floor to thereby prevent damage from any equipment or vehicles atop the upper floor. Builders using the vents described herein will appreciate that the floor may be poured in sections. They may pour concrete only between two vents and need not complete the entire floor in a single pour.

In an alternative embodiment, the method may further comprise the steps of initially forming a lower floor; and forming a plurality of pony walls atop said lower floor in substantially parallel relation before placing at least one storage floor air vent across the plurality of pony walls.

In an alternative embodiment, the method may further comprise the step of: finishing the concrete slab edges adjacent the at least one cap 60 before removing the at least one cap.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
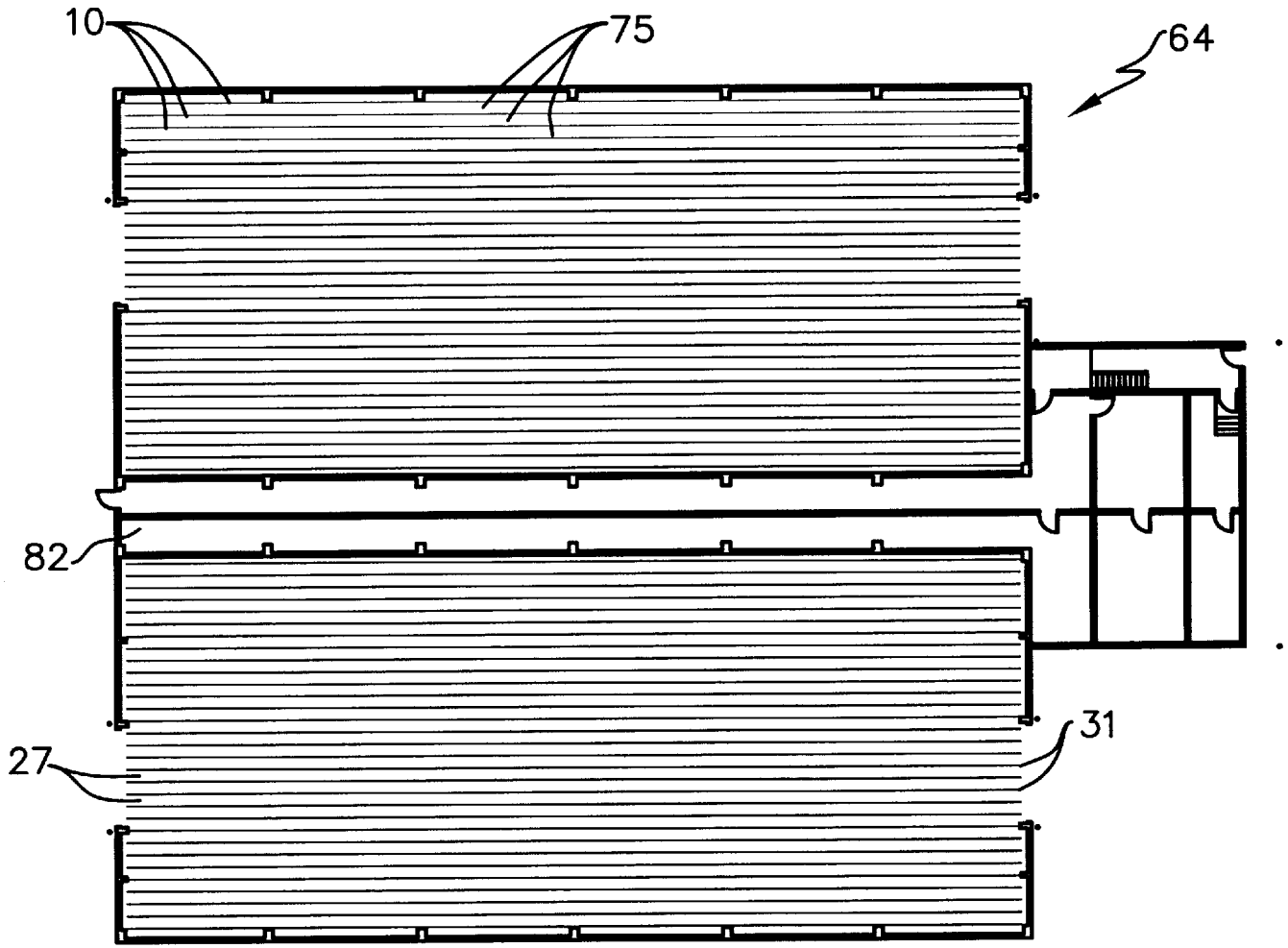
FIG. 1 is a top section view of a food storage building showing the building upper floor, storage floor air vents, and plenum.
Figure 2:
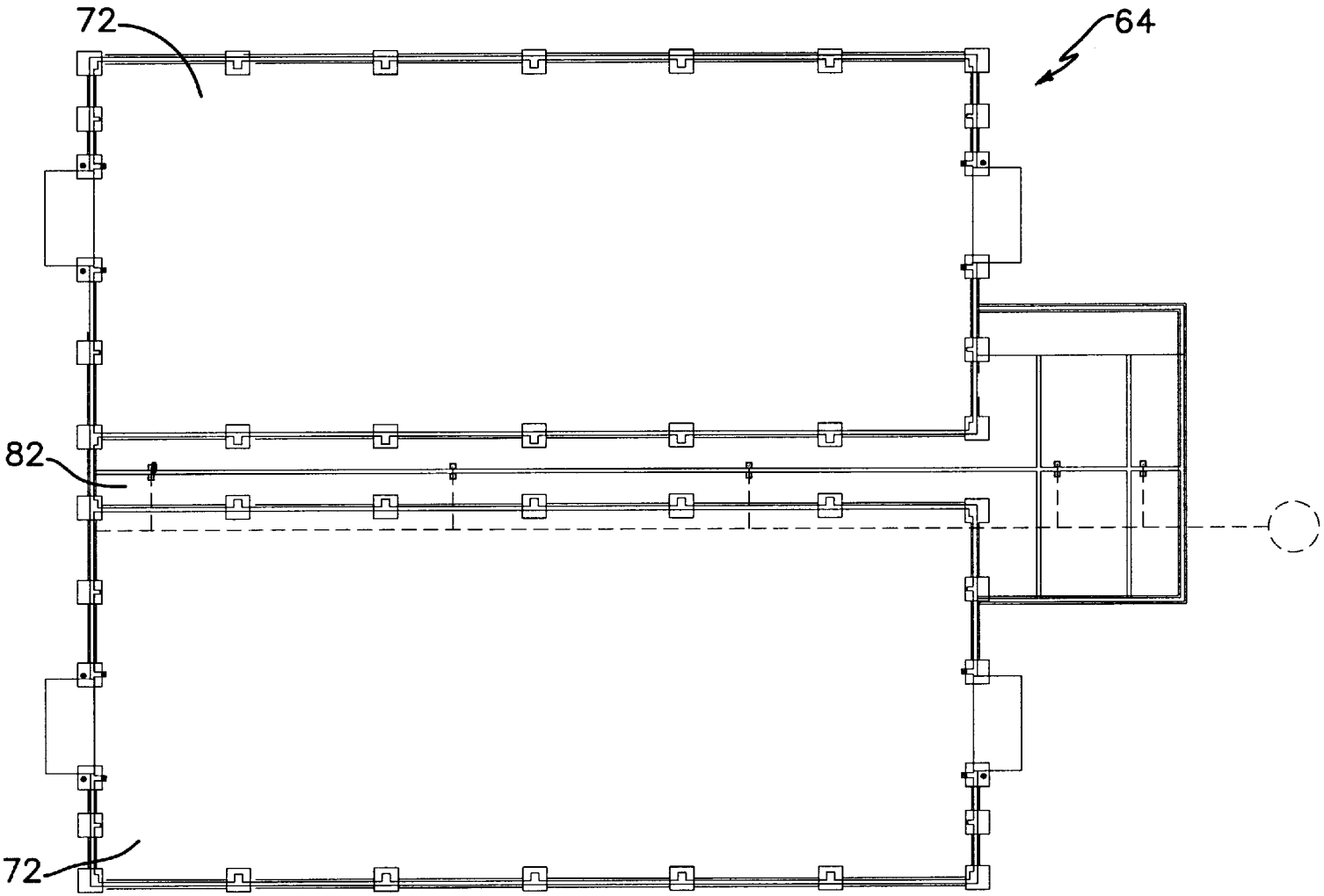
FIG. 2 is a top section view of a food storage building showing lower floor and plenum.
Figure 3:
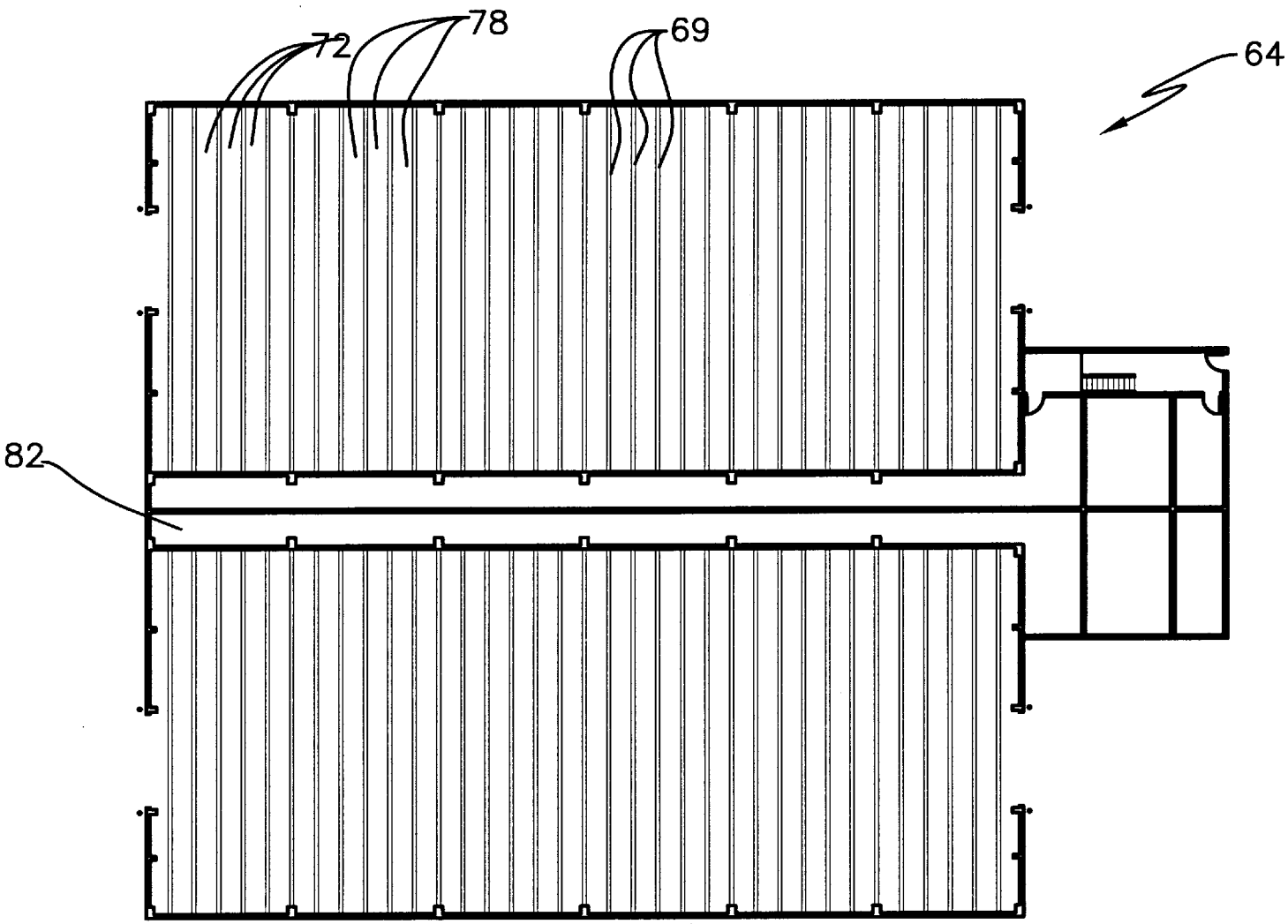
FIG. 3 is a top section view of a food storage building showing the lower floor, plenum and the pony walls.
Figure 4:
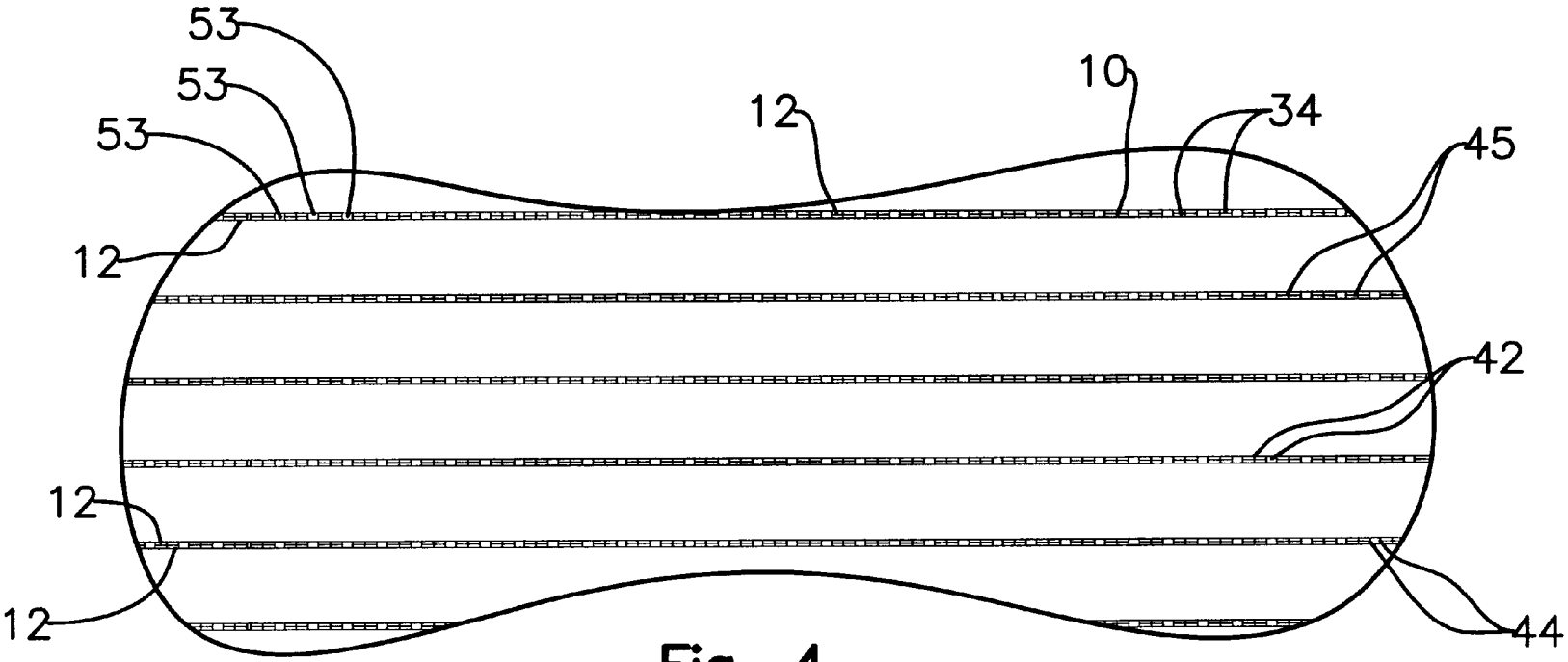
FIG. 4 is a top section exploded view of a building floor showing the air vents positioned atop a plurality of pony walls.
Figure 5:
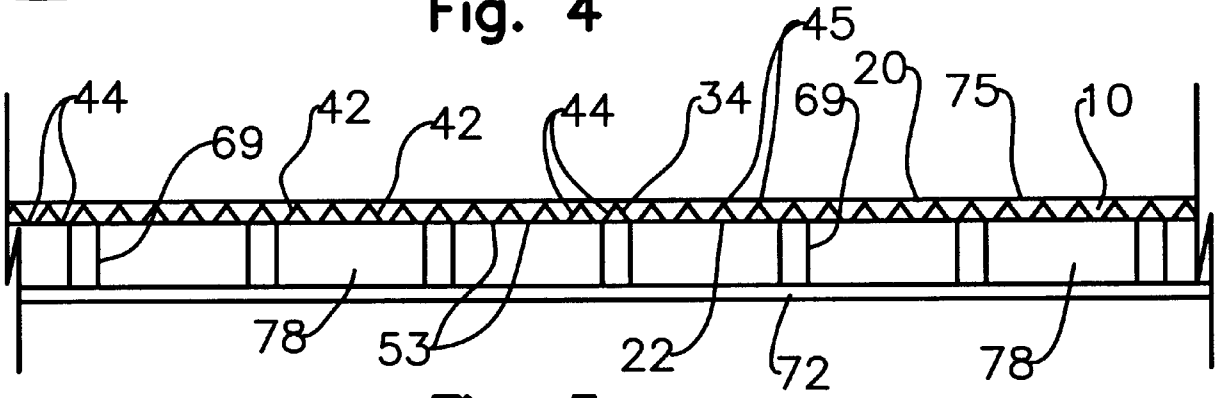
FIG. 5 is a side section view of a building floor showing the upper floor, vents positioned atop a plurality of pony walls. Also shown is the lower floor.
Figure 6:
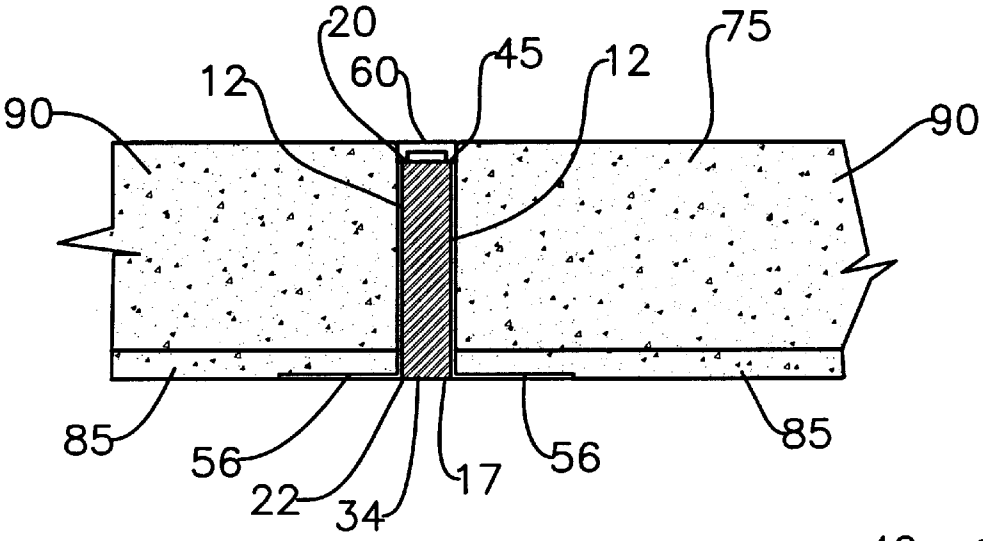
FIG. 6 is a front section view of the building floor showing the upper floor, concrete slabs, air vent and flange, support sheet, and pony wall. Also shown is a cap positioned atop the air vent.
Figure 7:
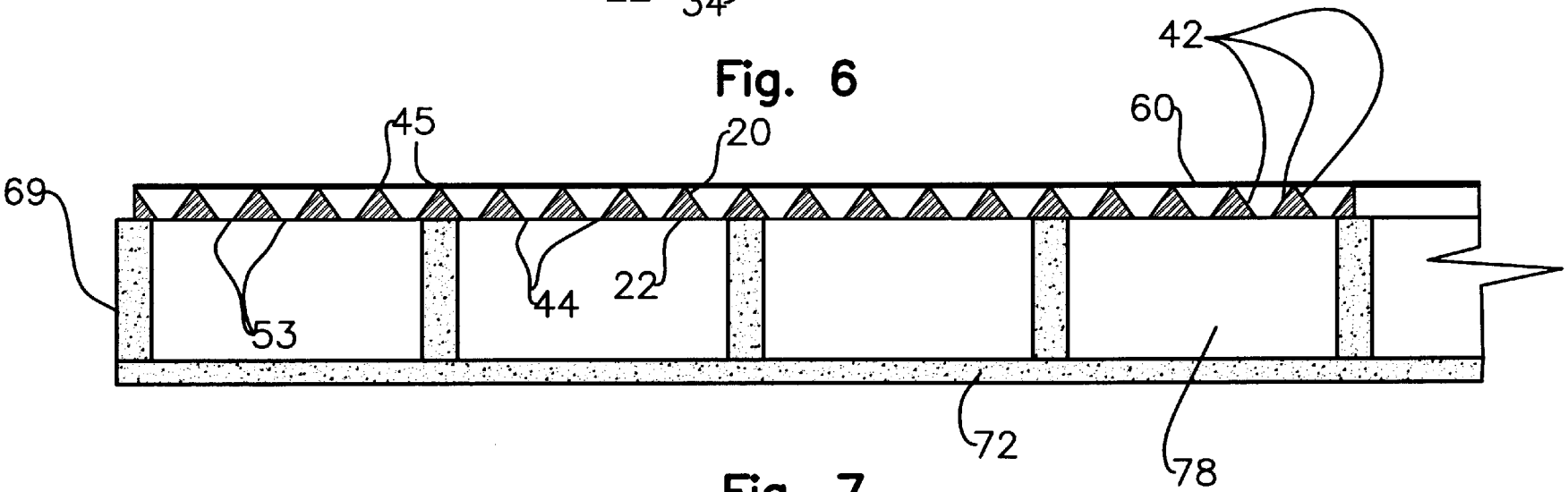
FIG. 7 is a side section view of the building floor showing the upper floor, vent, pony walls, lower floor, and cap positioned atop the air vent.

FIGS. 1 through 7 illustrate the preferred embodiment wherein the storage floor air vent 10 comprises at least two vent walls 12 positioned in substantially parallel relation to thereby define a channel 17 having a width in between said at least two vent walls 12, each of said at least two vent walls 12 having a top end 20, a bottom end 22, a first side end 27, and a second side end 31; a plurality of angular baffle members 34, each angular baffle member 34 composed of two segments 42 forming an apex 45 therebetween, each segment 42 having an end 44; said plurality of angular baffle members 34 positioned in between said at least two vent walls 12 in a linear arrangement, with each apex 45 facing upward proximal the top end 20 of each of said at least two vent walls 12, and each angular baffle member 34 is positioned a distance apart from the adjacent angular baffle member 34 to thereby define an orifice 53 between the segment ends 44 of adjacent angular baffle members 34.

In an alternative embodiment, the storage floor air vent 10 may comprise at least two vent walls 12 positioned in substantially parallel relation to thereby define a channel 17 having a width in between said at least two vent walls 12, each of said at least two vent walls 12 having a top end 20, a bottom end 22, a first side end 27, and a second side end 31; at least one angular baffle member 34 composed of two segments 42 forming an apex 45 therebetween, each segment 42 having an end 44; said at least one angular baffle member 34 positioned in between said at least two vent walls 12 in a linear arrangement, with said apex 45 facing upward proximal the top end 20 of each of said at least two vent walls 12, and said at least one angular baffle member 34 is positioned a distance apart from the first and second wall side ends to thereby define an orifice 53 between each segment end 44 and one of said first or second wall side ends.

The angular baffle member 34 may be of various shapes and configurations and may include more rounded configurations or shapes than what is shown in the figures. The angular baffle member 34 may be composed of a single member or the two segments 42 may be separate components joined together to form the angular baffle member 34.

The orifice 53 may be of various sizes depending upon the storage contents and ventilation requirements.

The storage floor air vent 10 may further comprise a flange 56 extending outwardly and approximately normal from the bottom end 22 of each of said at least two vent walls 12.

The storage floor air vent 10 may further comprise at least one cap 60 having a width approximately equal to the channel 17 width; said at least one cap 60 is positioned atop at least two of said apexes. The at least one cap 60 may be of various shapes, sizes or configurations.

In an alternative embodiment of the storage floor air vent, said at least one cap 60 is secured to said at least two apexes 45 by, but not limited to, bolts, screws, rivets, or other means.

In the preferred embodiment of the storage floor air vent, the angular baffle member 34 apexes 45 are juxtaposed the top end 20 of the vent walls 12 but they may be positioned a distance below the top end 20 of the vent walls 12.

The storage floor air vent and the cap are preferably composed of metal but may be composed of other materials including, but not limited to, rigid materials such as plastics and the like.

The invention further discloses a building floor 64 which may comprise a lower floor 72; a plurality of pony walls 69 positioned atop the lower floor 72 in substantially parallel relation; an upper floor 75 positioned atop the plurality of pony walls 69 to thereby define an air duct 78 in between adjacent pony walls 69 and said lower and upper floors, said upper floor 75 comprising at least one storage floor air vent 10 positioned atop the plurality of pony walls 69 in a substantially orthogonal relation to said plurality of pony walls 69 with each vent 10 wall bottom end 22 proximal the air duct 78 in between adjacent pony walls 69.

Each of said pony walls 69, upper and lower floors may be composed of, but not limited to, concrete, dirt, clay, metal compositions, wood, or other materials. The preferred material is concrete. Each vent apex is preferably positioned a distance below the top of the upper floor 75 to thereby prevent damage from any equipment or vehicles atop the upper floor 75.

The building floor 64 may further comprise at least one plenum 82 juxtaposed said air duct 78 in between adjacent pony walls 69.

In an alternative embodiment of the building floor 64, said lower floor 72 may be sloped toward said plenum 82 to thereby allow for liquid run-off from said lower floor 72 toward said plenum 82.

The invention further discloses a method of constructing a building floor 64 comprising the steps of: placing at least one storage floor air vent 10 in a substantially orthogonal position across a plurality of pony walls 69 in substantially parallel relation to each other, said at least one storage floor air vent 10 having at least one cap 60 covering the top end 20 of the at least one storage floor air vent 10; placing at least one support sheet 85 across said pony walls 69 and next to said at least one storage floor air vent 10 and atop each flange 56; covering the floor area, encompassing the at least one support sheet 85, with a concrete slab 90 sufficiently to permit concrete finishing; and removing the at least one cap 60. Said at least one support sheet 85 is preferably composed of galvanized metal but may be composed of other materials including, but not limited to, plastics or other rigid materials. Each vent apex is preferably positioned a distance below the top of the upper floor 75 to thereby prevent damage from any equipment or vehicles atop the upper floor 75.

In an alternative embodiment, the method may further comprise the steps of initially forming a lower floor 72; and forming a plurality of pony walls 69 atop said lower floor 72 in substantially parallel relation before placing at least one storage floor air vent 10 across the plurality of pony walls 69.

In an alternative embodiment, the method may further comprise the step of: finishing the concrete slab 90 edges adjacent the at least one cap 60 before removing the at least one cap 60.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A storage floor air vent comprising:

a. at least two vent walls positioned in substantially parallel relation to thereby define a channel having a width in between said at least two vent walls, each of said at least two vent walls having a top end, a bottom end, a first side end, and a second side end, b. at least one angular baffle member composed of two segments forming an apex therebetween, each segment having an end;

c. said at least one angular baffle member positioned in between said at least two vent walls in a linear arrangement, with said apex facing upward proximal the top end of each of said at least two vent walls, and said at lest one angular baffle member is positioned a distance apart from the first and second wall side ends to thereby define an orifice between each segment end and one of said first or second wall side ends.

d. a flange extending outwardly and approximately normal from the bottom end of each of said at least two vent walls.

2. The storage floor air vent of claim 1 further comprising:

a. at least one cap having a width approximately equal to the channel width;

b. said at least one cap is positioned atop at least two of said apexes.

3. The storage floor air vent of claim 1, wherein said at least one cap is secured to said at least two apexes.

4. A storage floor air vent comprising:

a. at least two vent walls positioned in substantially parallel relation to thereby define a channel having a width in between said at least two vent walls, each of said at least two vent walls having a top end, a bottom end, a first side end, and a second side end;

b. at least one angular baffle member, each angular baffle member composed of two segments forming an apex therebetween, each segment having an end;

c. said at least one angular baffle member positioned in between said at least two vent walls in a linear arrangement, with said apex facing upward proximal the top end of each of said at least two vent walls, and said at least one angular baffle member is positioned a distance apart from the first and second wall side ends to thereby define an orifice between each segment end and one of said first or second wall side ends d. a flange extending outwardly and approximately normal from the bottom end of each of said at least two vent walls.

5. The storage floor air vent of claim 4, further comprising:

a. at least one cap having a width approximately equal to the channel width;

b. said at least one cap is positioned atop at least two of said apexes.

6. The storage floor air vent of claim 5, wherein said at least one cap is secured to said at least two apexes.

7. The storage floor air vent of claim 4, wherein:

a. the angular baffle member apexes are juxtaposed the top end of the vent walls.

8. A building floor ventilation system comprising:

a. at least one storage floor air vent of claim 5, positioned in a floor;

b. at least one air duct positioned below said floor to thereby allow the transmission of air from said at least one duct through said at least one storage floor air vent.

9. A building floor comprising:

a. a lower floor;

b. a plurality of pony walls positioned atop the lower floor in substantially parallel relation;

c. an upper floor positioned atop the plurality of pony walls to thereby define an air duct in between adjacent pony walls and said lower and upper floors, said upper floor comprising at least one storage floor air vent of claim 5 positioned atop the plurality of pony walls in a substantially orthogonal relation to said plurality of pony walls with each vent wall bottom end proximal the air duct in between adjacent pony walls.

10. The building floor of claim 9 further comprising:

a. at least one plenum juxtaposed said air duct in between adjacent pony walls.

11. The building floor of claim 10 wherein:

a. said lower floor is sloped toward said plenum to thereby allow for liquid run-off from said lower floor toward said plenum.

12. A method of constructing a building floor comprising the steps of:

a. placing at least one storage floor air vent of claim 5 in a substantially orthogonal position across a plurality of pony walls in substantially parallel relation to each other, said at least one storage floor air vent having at least one cap covering the top end of the at least one storage floor air vent;

b. placing at least one support sheet across said pony walls and next to said at least one storage floor air vent of claim 5 and atop each flange;

c. covering the floor area, encompassing the at least one support sheet, with a concrete slab sufficiently to permit concrete finishing; and d removing the at least one cap.

13. The method of claim 12 further comprising the steps of:

a. forming a lower floor; and b. forming a plurality of pony walls atop said lower floor in substantially parallel relation before step a. of claim 12.

14. The method of claim 12 further comprising the step of:

a. finishing the concrete slab edges adjacent the at least one cap before step d. of claim 12.

* * * * *